United States Patent [19]

Wawrzynek et al.

[11] Patent Number: 4,736,663

[45] Date of Patent: Apr. 12, 1988

[54] ELECTRONIC SYSTEM FOR SYNTHESIZING AND COMBINING VOICES OF MUSICAL INSTRUMENTS

[75] Inventors: John C. Wawrzynek; Carver A. Mead, both of Pasadena, Calif.

[73] Assignee: California Institute of Technology, Pasadena, Calif.

[21] Appl. No.: 662,708

[22] Filed: Oct. 19, 1984

[51] Int. Cl.[4] ..... G10H 1/02; G10H 1/08; G10H 1/12

[52] U.S. Cl. ..... 84/1.26; 84/DIG. 9; 84/DIG. 10; 364/724; 331/78; 381/51

[58] Field of Search ..... 84/1.01, 1.19, 1.24–1.26, 84/DIG. 9, DIG. 10; 364/724; 333/165, 166; 331/78; 381/51

[56] References Cited

U.S. PATENT DOCUMENTS

| | | | |
|---|---|---|---|
| 4,142,432 | 3/1979 | Kameyama et al. | 84/1.01 |
| 4,185,529 | 1/1980 | Kitagawa | 84/1.01 |
| 4,296,384 | 10/1981 | Mishima | 331/78 |
| 4,336,736 | 6/1982 | Mishima | 84/1.26 |
| 4,356,558 | 10/1982 | Owen et al. | 364/724 |
| 4,393,272 | 7/1983 | Itakura et al. | 364/724 X |
| 4,398,262 | 8/1983 | Williams | 364/724 |
| 4,401,975 | 8/1983 | Ferguson et al. | 84/1.26 X |
| 4,495,591 | 1/1985 | Loomis, Jr. | 364/724 |
| 4,554,858 | 11/1985 | Wachi | 84/1.19 |
| 4,586,416 | 5/1986 | Sano | 331/78 X |

*Primary Examiner*—S. J. Witkowski

*Attorney, Agent, or Firm*—Freilich, Hornbaker, Rosen & Fernandez

[57] ABSTRACT

A digital system is provided for synthesizing individual voices of musical instruments, which may then be combined into a musical composition. The system for a single voice is comprised of means for solving a system of simultaneous finite difference equations, where time is represented by real time in the computations. Musical sounds of the voice can then be produced by repetitiously solving the difference equations that model the instrument in real time, using an array of elemental means named "universal processing elements" (UPEs) interconnected by a matrix to each other and to external input and output terminals, and varying the sounds by varying the parameters. Each UPE is capable of computing $Y=A+(B\times M)$ from pipelined bit-serial inputs. The difference equations model a general linear filter, a second-order linear filter, a nonlinear polynomial function, and a random number (noise) generating function. These functions formed by interconnecting UPEs may in turn be combined by the interconnection matrix to form functional sections, and the sections are in turn combined by the interconnection matrix to form voices of struck or plucked instruments and blown instrument, or hybrid voices that partake of the attack characteristic of struck or plucked instruments, and tonal characteristics of a blown instrument.

3 Claims, 9 Drawing Sheets

ELECTRONIC SYSTEM FOR SYNTHESIZING AND COMBINING VOICES OF MUSICAL INSTRUMENTS

This invention is related to application Ser. No. 524,545 filed Aug. 19, 1983, for an ELECTRONIC MUSICAL INSTRUMENT by Carver A. Mead, John C. Wawrzynek and Tzu-Mu Lin. FIGS. 1, 2, 3*a*, 5 and 13 labeled "prior art" are completely described in the aforesaid related application, as is FIG. 3*b*, which merely illustrates the time relationship between signals in the UPE of FIG. 3*a* and FIGS. 3*c* and 3*d* which merely illustrate symbols sometimes used to represent the UPE of FIG. 2 or 3*a*, the same as in the aforesaid copending application.

BACKGROUND OF THE INVENTION

This invention relates to electronic sound synthesis, and more particularly to a method and apparatus for generating musical sound waveforms of struck and plucked instruments and wind instruments.

Sounds that come from physical sources are naturally represented by differential equations in time. Since there is a straight-forward correspondence between differential equations in time and finite difference equations, it is possible to model musical instruments as simultaneous finite difference equations. Musical sounds can be produced by solving the difference equations that model instruments in real time, and converting the information from digital to analog form.

The computational bandwidth that is needed to compute musical sounds is enormous. For the sampled waveform representation of sound, it is necessary to produce samples at a rate of about 50K samples/sec. Assuming that there are about 100 computational operations per sample for each voice, five million operations are required per second per voice. Each operation involves a multiplication and an addition. A "voice" is the sound of one wind instrument horn or one instrument string. A midsize computer of today is capable of about only 250,000 arithmetic operations per second which means it is only capable of computing about 1/20 of a single voice, so it is hopeless to compute the sounds in real time with a midsize computer. Even today's most powerful computers are capable of computing only a small number of voices.

The idea of distributing computations for concurrent execution by a plurality of programmed digital computers does not hold much promise. These concurrent computing machines, sometimes called homogeneous machines, fail to support the generation of sound because they are built with a fixed interconnection between their processors. In order to map a problem like musical sound generation onto such machines, the processors must be programmed to provide the communication between various parts of the model. This results in the machine spending much of its time shuffling data.

People in the past have tried to avoid the enormous computation bandwidth of sound generation by using special musical techniques, such as frequency modulation, to generate evolving partials of various horn voices. While this approach and other similar ones can produce pleasing musical results, the player of the instrument is given control of parameters that do not necessarily have any direct physical interpretation and are just artifacts of the model. It would be desirable to supply a musician or composer with, for example, a string instrument with string whose mass, stiffness, length and tension can be varied dynamically, and a wind instrument whose corresponding parameters can be similarly varied. This capability is possible if a representation of the instrument is based on its physics.

An even larger problem with the prior art methods is that they produce models that require updating of internal parameters at a rate that is many times that which occurs in real musical instruments. The control, or update, of parameters has been an unmanageable problem.

SUMMARY OF THE INVENTION

In accordance with the present invention, a digital system is provided for synthesizing individual voices of musical instruments, which may then be combined into a musical composition. The system for a single voice is comprised of means for solving a system of simultaneous finite difference equations, where time is represented by real time in the computations. Musical sounds of the voice can then be produced by repetitiously solving the difference equations that model the instrument in real time, using an array of elemental means named "universal processing elements" (UPEs) interconnected by a matrix to each other and to external input and output terminals, and varying the sounds by varying the parameters. Each UPE is capable of computing $Y=A+(B\times M)$ from pipelined bit-serial inputs. The difference equations model: (1) a general linear filter producing an output signal $y_n$ according to the following linear difference equation:

$$y_n=a_o x_{n-1}+a_1 a_{xn-2}+a_2 x_{n-2}+\ldots a_M x_{o-m+1}+b_1 y_{n-1}+b_2 y_{n-2}+\ldots b_N y_{n-N};$$

(2) a second-order linear filter producing an output signal $y_n$ according to the following second-order linear difference equation $$y_n=2R\cos\theta_c y_{n-1}-R^2 y_{n-2}+x_{n-2};$$

(3) a nonlinear polynomial function according to the following finite difference equation $$y=k_o+k_2k_3+k_3Gx+R_2x^2+Gx^3,$$

which is a particular (3rd order) polynomial from the more general (arbitrary power series) polynomial function which can be generated in accordance with one aspect of the present invention; and (4) a random number (noise) generating function according to the following equation:

$$x_n=p(x_{n-1}\mathrm{mod}_r)+q$$

where r is the radix of the UPE ($2^{32}$ in the example disclosed) achieved by applying the Y output of a UPE to the B input, and p and q to the respective A and M input terminals, where $x_{n-1}\mathrm{mod}_r$ operation is achieved by feeding the Y output, having twice the number of bits as the A and B inputs, directly back to the B input.

These functions formed by interconnecting UPEs may in turn be combined by the interconnection matrix to form functional sections, and the sections are in turn combined by the interconnection matrix to form voices of struck or plucked instruments and blown instruments, or hybrid voices that partake of the attack characteristic of struck or plucked instruments, and tonal characteristics of a blown instrument. A voice of a struck or plucked instrument is synthesized by: an attack section implemented with a second order linear filter (resonator) which responds to a pulse simulating the striking or plucking of the instrument, and a noise modulation section using a random number generator; and a resonator section implemented with a bank of second-order linear filters in parallel. A voice of a blown instrument is synthesized by a noise modulation section and a resonator section with a closed-loop feedback through a nonlinear function section (third order polynomial). A hybrid voice is synthesized by an arrangement like that for the blown instrument, but with the loop closed through an attack section with a UPE that multiplies the output of the nonlinear function section by a gain coefficient and adds to it the input pulse of the attack section.

The novel features of the invention are set forth with particularity in the appended claims. The invention will best be understood from the following description when read in connection with the accompanying drawings.

DESCRIPTION OF PREFERRED EMBODIMENTS

Figure 1:
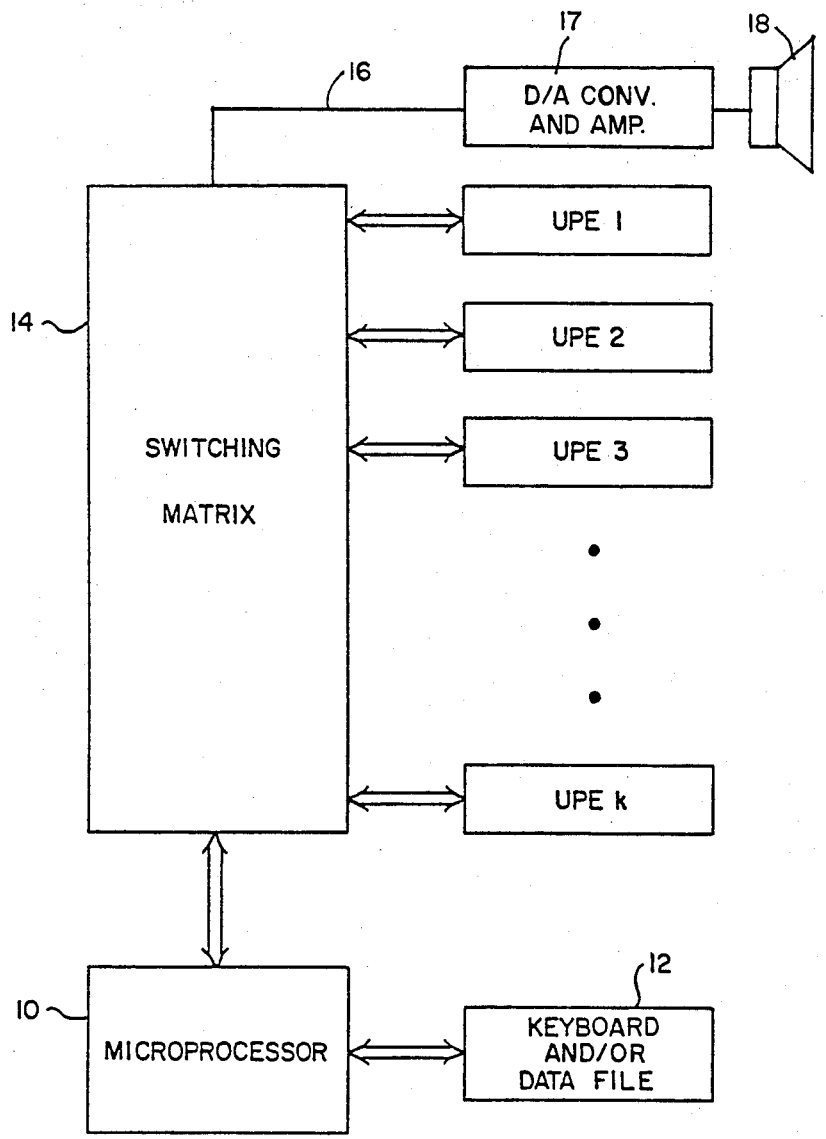
FIG. 1 PRIOR ART
FIG. 1 is a schematic diagram of the architecture for interconnecting an array of UPEs as desired through a matrix, with connections to the UPEs used as required for input signals from global conductors, or from other UPEs, and to transmit output signals from selected UPEs to other UPEs, for adding and/or mixing before conversion to an analog form required by speakers that produce the sound, all under control of a programmed microprocessor, which in turn is controlled by a user at a keyboard or commands stored in a data file, as described in prior application Ser. No. 524,545 filed Aug. 19, 1983.

A natural architecture for solving finite difference equations is one with an interconnection matrix between processors that can be reconfigured (programmed), as illustrated in FIG. 1. It shows the general architecture of a system embodying the present invention to be described more fully with reference to FIGS. 6 through 19, which is a synchronous digital system for synthesizing musical sounds of a struck or plucked instrument, a blown instrument and hybrid of those instruments. The system is comprised of a plurality of universal processing elements (UPEs) 1, 2, 3 . . . k controlled by a programmed unit 10, shown as a synchronous microprocessor, in response to commands from an input unit 12, shown as a keyboard and/or a data file. The UPEs are controlled by the microprocessor through a switching matrix 14. Synthesized signal outputs appear at a conductor 16 connected to a digital-to-analog converter and amplifier 17 which drives a speaker system 18. The nature of each signal appearing on any given conductor during any given time interval is a function of how one or more UPEs are interconnected and loaded with coefficients by the microprocessor through the switching matrix.

Realization of an instrument involves reconfigurating the connection matrix between the processing elements along with configuring connections to the outside world both for control and updates of parameters.

Thus, processing elements are placed together to form an array, and then joined by a reconfigurable interconnection matrix. A general purpose computer supplies updates of parameters to the processing elements and provides an interface to the player of the instrument. The external computer also supplies the bit patterns for the interconnection matrix. Synthesized signal outputs go to a digital-to-analog converter 17, which may drive a speaker, for example.

In order to implement a reconfigurable connection matrix, a bit serial representation of samples facilitates the use of single wire connections between computational units, drastically reducing the complexity of implementation. Bit serial implementations also have the advantage that computational elements are very small and have inexpensive realizations. A problem with bit serial systems is that they must run at a clock rate that is higher than that of those that operate on a word at a time. In our implementations, even with 64 bit samples, the bit clock rate is only 3 MHz, which is well within the range of current IC technology.

The basic unit of computation chosen is called a UPE (Universal Processing Element) which computes the function:

$$A+B\times M+D\times(1-M) \quad (1)$$

In its simplest mode of computation, where D=0, the function of a UPE is a multiplication and an addition. This forms a digital integrator that is the basic building block for solving linear difference equations. If D is not set to 0, the output of the UPE is the linear interpolation between B and D where M is the constant of interpolation. Interpolation is important in sound synthesis for mixing signals. All the inputs and outputs to the UPE are bit serial. UPEs can be connected together with a single wire.

Figure 2:
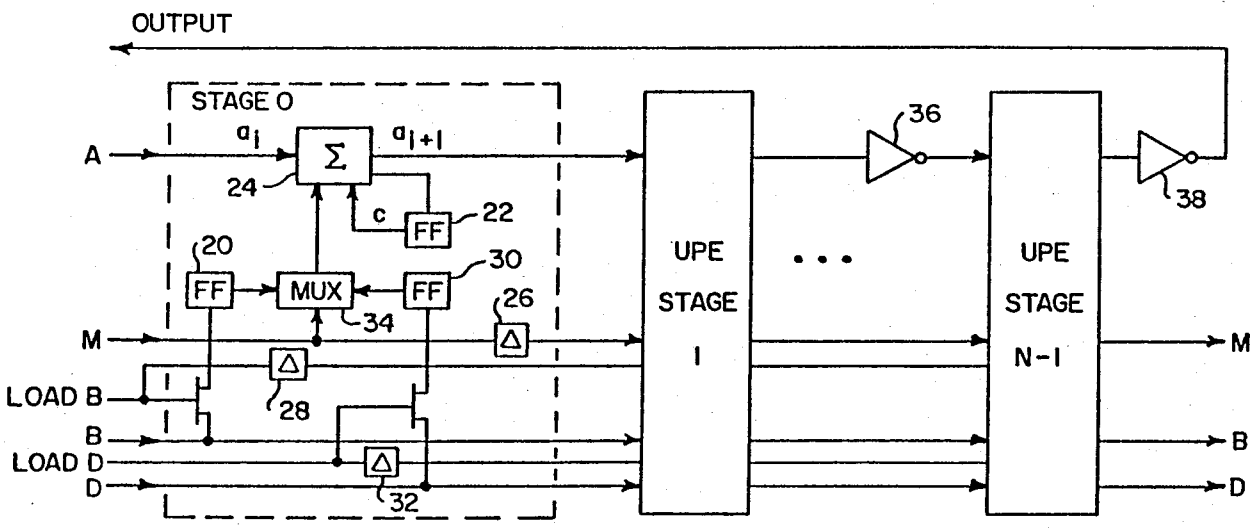
FIG. 2 PRIOR ART
FIG. 2 is a diagram of one UPE showing an exemplary embodiment for each stage thereof.

Each UPE consists of a plurality of stages 0, 1, . . . N−1, as shown in FIG. 2. There is one simple stage for each bit in a multiplier word, B, applied as an input to the UPE. That multiplier is stored (in inverse order) in a register consisting of flip-flops, such as a flip-flop 20 for stage 0.

Each simple stage contains an AND function for one bit of multiplication, a flip-flop 22 for one bit of storage for the carry, and a three input adder 24 to sum the output of the preceding stage (or the input A in the case of the first stage) with the one bit multiply and the carry from the last one bit multiply. The output of the adder, $a_{i+1}$, contributes along with the result from all of the other stages to one bit in the final result A+(M×B).

The multiplicand M is passed through all stages of the multiplier, one bit at a time. A delay element 26, which may be a stage of a shift register, delays the multiplier bit being transferred from one stage to the next, one bit at a time. The multiplier B is loaded serially as the multiplicand M is passed through the multiplier one bit at a time, using a delay element 28 to delay the load B clock pulse as the binary digits are entered in the register comprised of flip-flops 20 in each stage. Similarly, another coefficient, D, is stored in a register comprised of a flip-flop 30 in each stage using delay elements 32 in each stage.

The AND function is implemented with a multiplexer 34 which chooses the input to the adder 24 between a bit of the stored word B and a bit of the stored word D. The multiplexer 34 is controlled by the multiplicand M so that each stage computes b·m+d·(1−m) and the entire array computes A+[B×M+D×(1−M)]. If the word D is zero, then each of the multiplexers effectively performs as an AND gate, with each stage computing b·m, and the entire array of UPE stages computing A+[B×M]. If the word D is not zero, the final result is the linear interpolation between D and B, with M being the interpolation constant, i.e., the result equals A+(B−D)×M+D.

The multiplier B is stored in the multiplier register in reverse order, that is with bit $b_0$ in stage 0, bit $b_1$ in stage 1, and so on, by placing the multiplier on the B input line one bit at a time, as a load control pulse is passed from stage to stage. As each stage recives the load pulse, it loads its flip-flop with the current bit on the B input line. The D input is loaded into its separate register in the same manner when it is required. The multiplicand M is not stored in a register, but is delayed one bit cycle in each stage so that it can flow through and be on operated by each bit of the multiplier B, one bit at a time. Thus, as the multiplier B is being loaded, it is possible to begin passing the multiplicand M into the array of stages and perform the first 32 bits of multiplication.

In the course of the multiplication operation, each bit of the final result is formed by every stage adding its result to the result from the previous stage, and passing it on. Consequently, there is a propagation delay for each bit of the final result proportional to the number of stages. This delay can be avoided by using a conventional pipelining technique which consists of the addition of an extra bit-time delay element on the $a_{i+1}$ line, and on every one of the lines which connects from one stage to the next. These extra delay elements are not shown in FIG. 2 to simplify the diagram.

The advantage of pipelining is that propagation delay for the array is proportional only to the delay in one stage, and not to the number of stages, although it does cause an initial delay through the pipeline. However, if the data being processed is a continuous stream, as in sound synthesis, this initial delay proportional to the total number of stages must only be suffered once at the beginning of the stream.

Figure 3A:
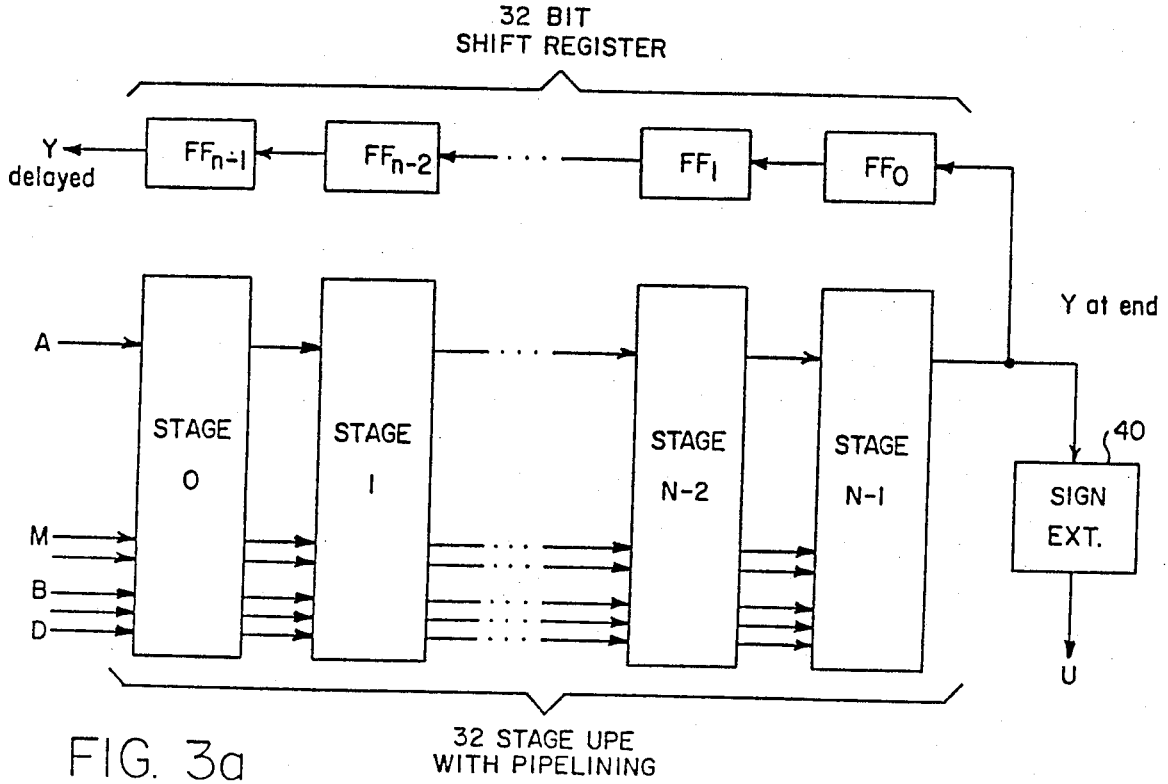
FIG. 3a PRIOR ART
FIG. 3*a* is a diagram of a variation in the architecture of one UPE for the purpose of generating from the primary output terminal Y having 2n bits a secondary output terminal U having only n bits, where n is the number of stages chosen to be 32 in the exemplary embodiment of the invention.
Figure 3C:
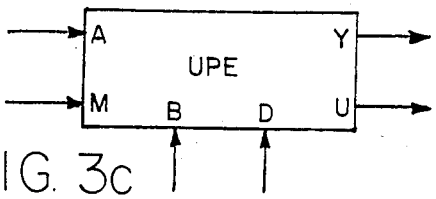
FIG. 3c PRIOR ART
FIG. 3*c* illustrates a symbol for the UPE used in other figures.
Figure 3D:
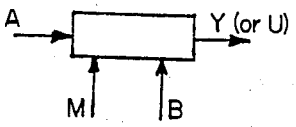
FIG. 3d PRIOR ART
FIG. 3*d* illustrates an alternate symbol sometimes used in other figures to simplify the diagrams.
Figure 3B:
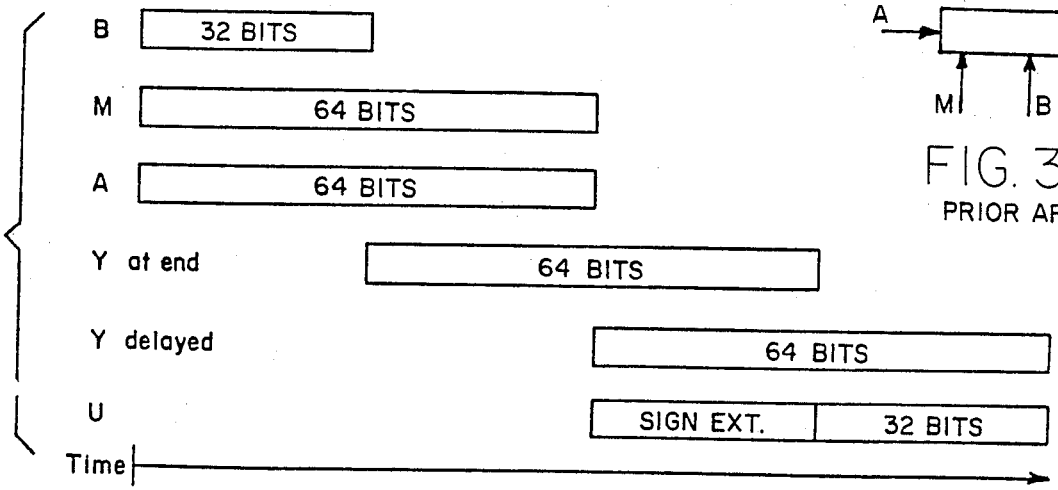
FIG. 3b PRIOR ART
FIG. 3*b* illustrates the time relationship between signals in the UPE of FIG. 3*a*.

FIG. 3*a* illustrates the preferred architecture used in each UPE. It contains n pipelined stages (0 through N−1), along with the same number of stages of a shift register, shown as flip-flops $FF_0$, $FF_1$ . . . $FF_{n-1}$, where n is chosen to be, for example, 32. The end result Y at the output of the 32 stages is fed into a sign extension circuit 40 which generates a U output by passing only the most significant 32 bits of the Y output, and then extending its sign bit over the next 32 bit cycles. Because the Y output is the product of two 32-bit numbers, it consists of 64 bits. Consequently, the first 32 bits of that product not used for the U output are stored in the 32-bit shift register. Since the Y output is thus delayed by 32-bit cycles, both the Y output and the U output appear in synchronism, as shown in FIG. 3*b*. It should be noted that the entire system of FIG. 1 is synchronized by clock pulses (not shown), and preferably by the clock pulses used for the synchronous microprocessor 10 and for the analog-to-digital converter 17.

The B input and the D input (not shown), are 32-bit two's complement numbers, and M and A are 64-bit two's complement numbers. However, it should be understood that the bit serial architecture implemented to perform multiplication and linear interpolation does not depend upon use of the two's complement. The two's complement representation is chosen only because it is more convenient.

A modification to the array of stages is necessary to accommodate two's complement numbers. Any two's complement number with binary point to the immediate right of the sign bit can be written as:

$$\sum_{i=0}^{n-2} b_i \cdot 2^{i-m} - b_{n-1} \cdot 2^{n-1-m} \quad (2)$$

Since each stage of the multiplier holds one bit of the word B, with stage n−1 holding $b_{n-1}$, and $b_o$ represents the least significant bit (LSB), the last stage must perform a subtraction of the incoming signal instead of an addition as in the other stages. The last stage is implemented with an inverter 36 on the incoming partial product along with an inverter 38 on its output as shown in FIG. 2. A two's complement number at the M input must be sign extended to guarantee correct operation. For example, if M is a 32-bit number then after all 32 bits of M have been fed in, an additional 32 bits, each a copy of the sign bit, must follow.

Using a fractional representation for numbers facilitates the computation of linear interpolations with the same efficiency as multiplication. This is made possible by the fact that, if the multiplicand M is a positive fraction and is represented by .xxxxx then one's complement $\overline{m} \approx 1-m$. It is this fact that is employed in implementing the AND function required for the one bit multiplication in each stage by a multiplexer (MUX) 34, as shown in FIG. 2. It should be recalled that the MUX is controlled by the multiplicand M to choose between the two signals B and D.

The last point that should be noted about the basic architecture of the UPE is that each stage receives its input from the previous stage. The first stage (stage 0) has no previous stage and therefore takes its inputs from the switching matrix 14 shown in FIG. 1. The input A for stage 0 need not be 0 in which case a number A is added to the final result.

Figure 4:
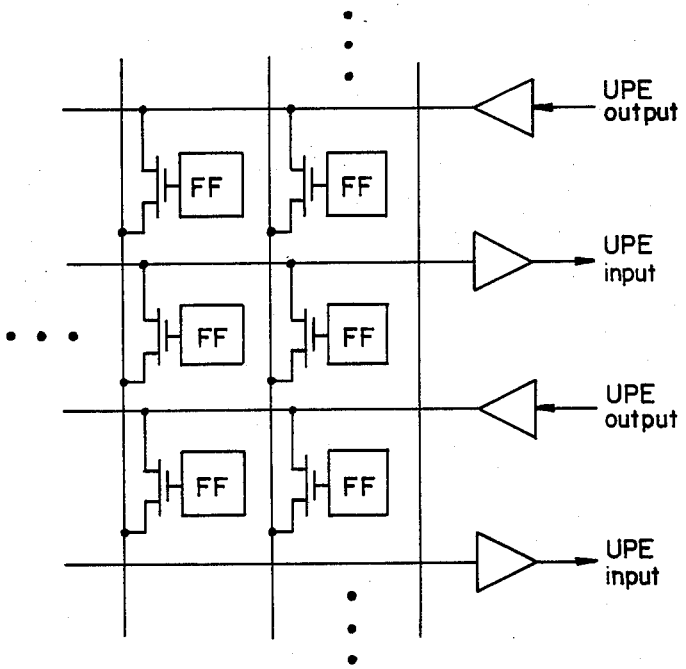
FIG. 4 illustrates an interconnection matrix for the discretion-only switching of UPEs.

One realization of the interconnection matrix 14 of FIG. 1 is shown in FIG. 4 in more detail. Each UPE output is programmed to connect to one line that is broadcast to a neighborhood of other UPEs. Inputs to UPEs are programmed in a similar manner by connection to one of the broadcast outputs. Programming is achieved by placing bit patterns in the control flip-flops FF that turn on MOS transistors at the intersection of horizontal and vertical conductors.

Inputs to UPEs that do not come from other UPEs, come from the controlling microprocessor through a switching matrix similar to the one connecting UPEs. Once a UPE receives an input it is held, so new values are sent only when the parameters of the model change.

Figure 5:
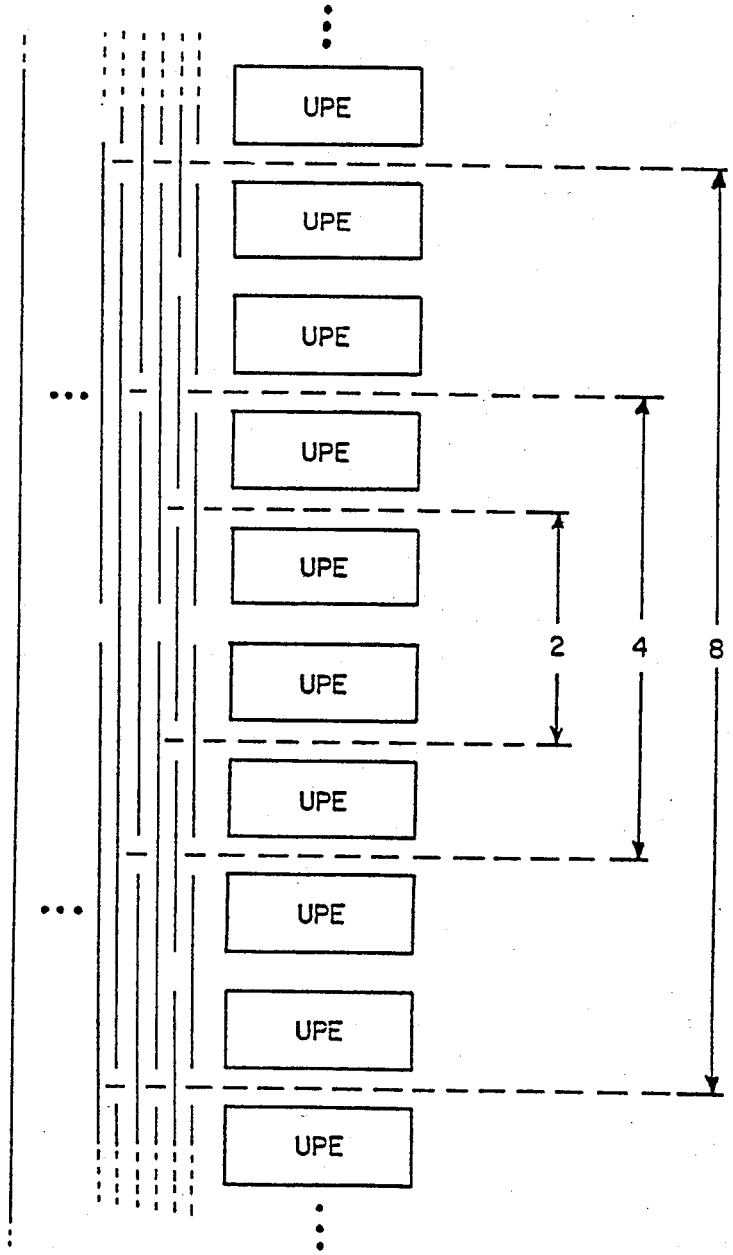
FIG. 5 PRIOR ART
FIG. 5 illustrates schematically an arrangement for vertical conductors in the matrix of FIG. 4 which permits discretionary interconnecting between neighboring UPEs selected out of groups of 2, 4, 8 . . . , and for interconnecting UPEs out of any groups through global conductors.

Since most interconnection patterns are local, the interconnection network need not provide full connectivity. FIG. 5 shows a scheme where there is a proportionally larger number of short local wires than longer global wires. Two sets of vertical conductors closest to the UPEs are short to connect only adjacent ones, while the next two sets of vertical conductors connect adjacent groups of four, and the next two sets of vertical conductors connect adjacent groups of eight, and so on. Only the last vertical conductor is a global one, and there may be more than one global conductor. Not shown in FIG. 5 are the horizontal conductors of the switching matrix.

Before describing applications of the UPEs to synthesis of plucked and struck instruments in accordance with the present invention, we introduce a symbol shown in FIG. 3*c* to be used for a UPE, with pipelining delays implemented as described with reference to FIG. 3*a*. It consists of a rectangle with the four inputs A, M, B and D, and the two outputs Y and U. The M, B and D inputs and the U output are 32-bit two's complement numbers between 2 and −2, which are sign extended to 64 bits in the case of M and U, as follows:

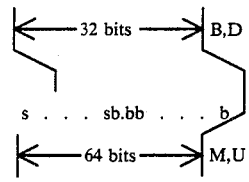

The A input and the Y output are two's complement numbers between 8 and −8, as follows:

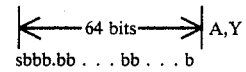

These two types of numbers restrict the way several UPEs may be interconnected, with rare exceptions, such as in the random number (noise) generator to be described with reference to FIG. 3. Usually the type of an output which feeds an input must match.

A single UPE can function as an integrator by connecting its Y output back into its A input through the switching matrix. This forms a running sum of the result from the inputs M, B and D. Such a running sum signal would seldom be used as such. Instead, it would be used as an input to one or more other UPEs through the switching matrix. It is the output of such other UPEs, combined as desired, that will then form a synthesized musical sound. An alternative symbol sometimes used in other figures to represent UPEs is shown in FIG. 3*d* where an input A to be added is shown at the end on the left, inputs B and M to be multiplied shown on the bottom (or top), D set equal to zero and the output Y (or U) at the end on the right. Which output is selected depends only upon how it is to be used, which in turn dictates which form the output must take, either 64 bits or 32 bits, as shown in FIG. 3*b*.

Before describing arrangements for synthesizing instruments, some more basic arrangements will first be described. An $M^{th}$ order linear filter may be defined by an equation written as:

$$y_n = \sum_{i=0}^{N} a_i x_{n-i} + \sum_{i=1}^{M} b_i y_{n-i} \quad (3)$$

where $x^n$ is the input at time sample n; $y_n$ is the output at time sample n; and the coefficients $a_o \ldots a_N$, $b_1 \ldots b_M$ are chosen to fulfill a given filtering requirement. The function is evaluated by performing the iteration of Equation (3) for each arrival of a new input sample. This is the general form of a linar filter; any linear filter can be described as a special case of Equation (3).

Figure 6:
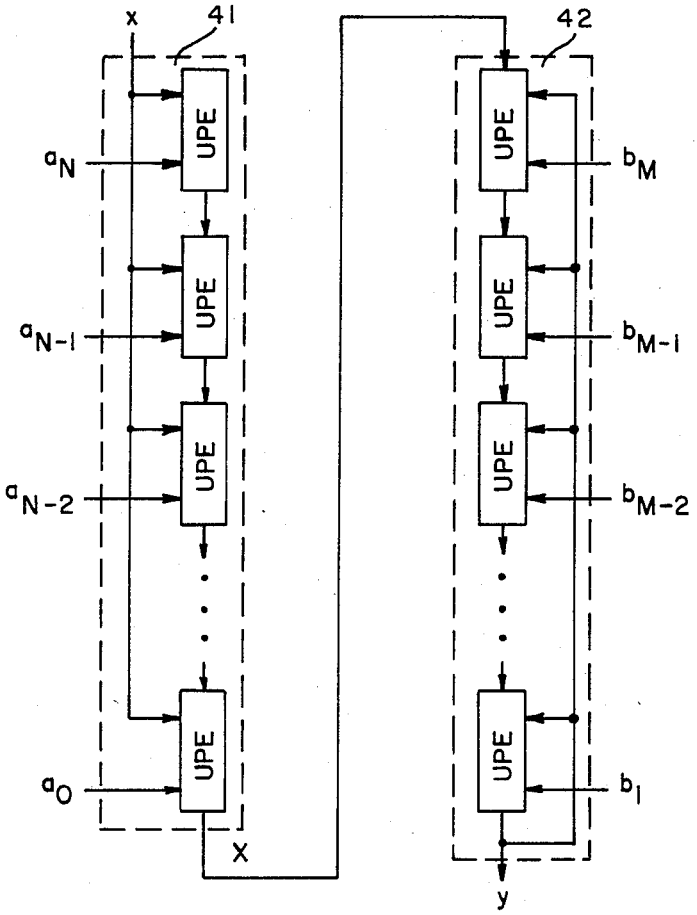
FIG. 6 illustrates a UPE network which directly implements a general linear filter.

FIG. 6 illustrates a UPE network which directly implements the general linear filter equation. Each UPE (with D=0) performs the function $(A+M\times B)z^{-1}$, i.e., a multiply, an addition and one unit of delay, where the unit is the time for processing a complete bit-serial word through the pipelined UPE. Note that the alternative symbol for each UPE shown in FIG. 3*d* is used, with A=0 for the first UPE. The input values are processed in a first section 41 by distributing the input signal x to each of N+1 UPE's, each one multiplies the input by a filter coefficient $a_i$, sums the result of the last UPE, and passes the total on to a second section 42 for further processing. Since each UPE provides one unit of delay, the signal at the output of the input processing section 41 is:

$$X=a_0x_{n-1}+a_1x_{n-2}+a_2x_{n-2}+\ldots+a_Mx_{i-M+1} \quad (4)$$

This result is summed with the result of the output processing section 42.

The output $y_n$ is distributed back to each of M UPE's in the output section 42. Each UPE of the output section 42 multiplies the output by a filter coefficient $b_i$, provides one unit of delay, sums its result with that of the last UPE, and passes the total on. The result at the end of the output processing section is:

$$y_n=b_1y_{n-1}+b_2y_{n-2}+\ldots+b_Ny_{n-N}+X \quad (5)$$

The result of the input processing section 41 is added to the output processing section 42 by feeding it into the A (addend) input of the UPE holding the $b_n$ coefficient. Adding the result from the input processing section 41 to the UPE holding the $b_n$ coefficient 42 has the effect of adding a net delay through the system equal to the number of UPE's in the output processing section.

From FIG. 6 it is clear that the number of UPE's needed to implement an $M^{th}$ order linear filter is equal to the number of coefficients in the input processing section 41 plus the number of coefficients in the output processing section 42.

As an example of a second order linear filter, consider the equation:

$$y_n=\alpha y_{n-1}+\beta y_{n-2}+x_n \quad (6)$$

Applying the z-transform yields the system function:

$$H(z)=\frac{Y(z)}{X(z)}=\frac{1}{1-\alpha z^{-1}-\beta z^{-2}} \quad (7)$$

Figure 7:
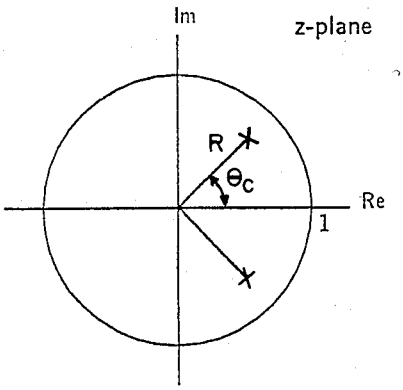
FIG. 7 is a diagram showing two resonant poles X in the Z-plane for a second order filter implemented.

Solving for the roots of the denominator leads to two cases. When $\alpha^2+4\beta\leqq 0$ the poles of H(z) are complex conjugates. They appear in the z-plane at $z=Re^{j\theta c}$ and $z=Re-^{j\theta c}$ as shown in FIG. 7. Here $\theta=2\pi\times\text{freq}/f_s=T$, where $f_s=1/T$ is the sampling frequency. R is the radial distance of the poles from the origin in the z-plane and $\theta_c$ is the angle off the real axis. Equation (7) can then be rewritten as:

$$H(z)=\frac{1}{(1-Re^{j\theta c}z^{-1})(1-Re^{-j\theta c}z^{-1})} \quad (8)$$

Multiplying out the denominator yields the following equation:

$$H(z)=\frac{1}{1-2R\cos\theta_c z^{-1}+R^2z^{-2}} \quad (9)$$

Rewriting Equation (6) yields:

$$y_n=2R\cos\theta_c y_{n-1}-R^2y_{n-2}+x_n \quad (10)$$

Figure 8:
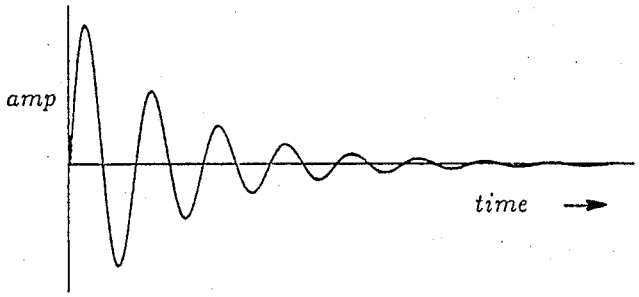
FIG. 8 is a diagram of the time domain impulse response for a damped second order resonator.

It is easy to show that Equation (10) leads to a sinusoidal time domain impulse response of the form:

$$\gamma R^{n-1}\cos[(n-1)\theta_c+\phi],\ k\geqq 1 \quad (11)$$

where $\gamma$ and $\phi$ depend on the partial fraction expansion of Equation (10). For values of $R<1$ this is a damped sine wave with R controlling the rate of damping and $\theta_c$ controlling the frequency of oscillation, as shown in FIG. 8. It is interesting to note that with $R=1$, the impulse response is a sine wave of constant amplitude, i.e., the system is an oscillator.

Figure 9:
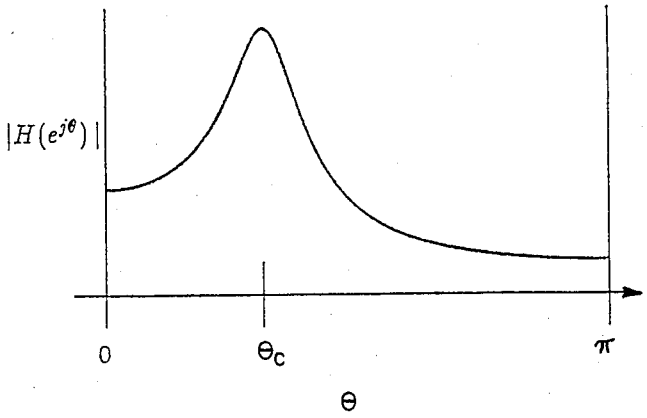
FIG. 9 is a graph of the magnitude of frequency response of a second order resonator acting as a bandpass filter with a center frequency defined by the angle $\theta_c$.

The system frequency response is found by substituting $e^{j\theta}$ for z in H(z). At $z=e^{j\theta}$, H(z) is identical to the discrete Fourier transform. The digital resonator acts as a bandpass filter in this case, with a center frequency defined by an angle $\theta_c$ and a bandwidth proportional to R, as shown in FIG. 9.

Figure 10:
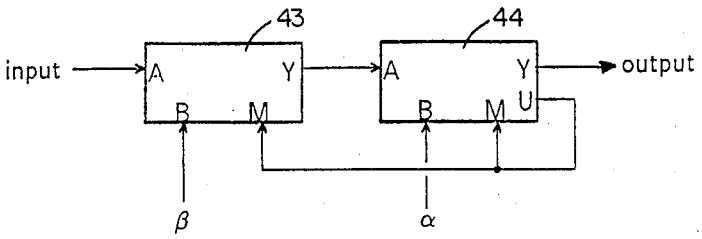
FIG. 10 illustrates the implementation of a second-order resonator using two UPEs as disclosed in the aforesaid patent application Ser. No. 524,545.
Figure 11:
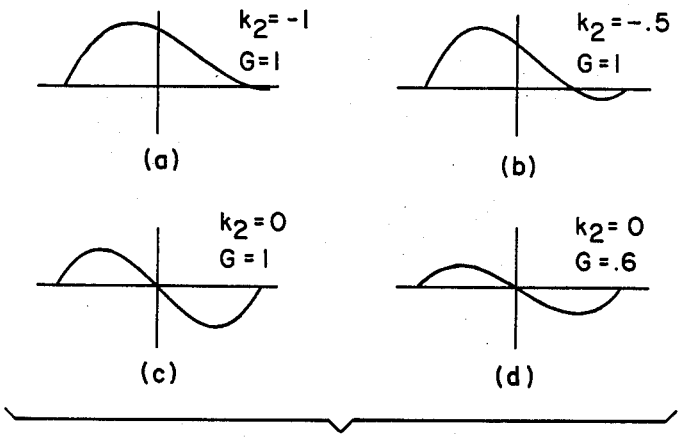
FIGS. 11*a* through 11*d* illustrate nonlinear functions characteristic of blown musical instruments.

A digital resonator is implemented directly using two UPEs, as shown in FIG. 10. UPE 43 computes $(-R^2Y+X)Z^{-1}$, and UPE 44 computes:

$$[2R\cos\theta_cY+(-R^2Y+X)z^{-1}]z^{-1}=2R\cos\theta_cYz^{-1}-R^2Yz^{-2}+Xz^{-2} \quad (12)$$

hence, $$y_n=2R\cos\theta_cy_{n-1}-R^2y_{n-2}+x_{n-2} \quad (13)$$

Figure 12A:
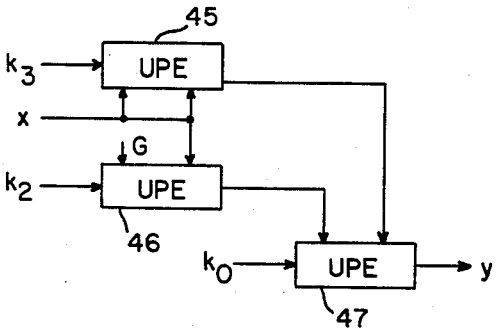
FIG. 12*a* illustrates the implementation of a third-order nonlinear polynomial function for generating the functions illustrated in FIGS. 11*a* through 11*c*.

The range of functions computable by UPEs are not restricted to linear ones. Certain phenomena in nature are best modeled as nonlinear functions. For example, consider the class of functions that relate pressure to velocity at the mouthpiece of a blown instrument. A function that is present in flute-like models is shown in FIG. 11*c*. This function and its variations, shown in FIGS. 11*a* through 11*d*, is computed using three UPEs, as is shown in FIG. 12*a*. The input signal x is sent to UPE 45 that multiplies x by itself creating a squared term, and adding a constant $k_3$. This same technique is used again with UPE 46 and UPE 47 to which a constant $k_o$ is added to arrive at the function:

$$y=k_o+k_2k_3+k_3Gx+k_2x^2+Gx^3 \quad (14)$$

Figure 12B:
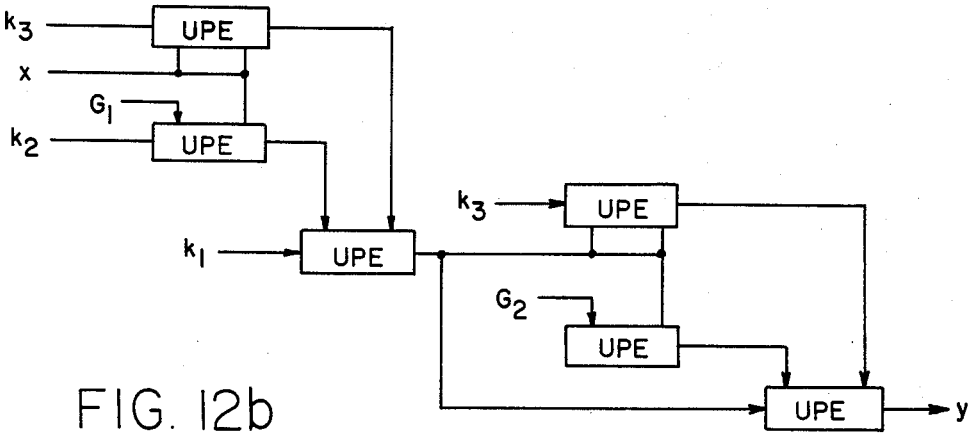
FIG. 12*b* illustrates the implementation of a higher-order polynomial function to show that an array of UPEs can be readily expanded to a polynomial of virtually any order.

That function is a third-order polynomial. For $k_o=0$ and $k_3=-1$, the constant multiplier G controls the nonlinear gain, as illustrated in FIGS. 11*c* and 11*d*. The coefficient $k_2$ controls the symmetry about the vertical axis, as shown in FIGS. 11*a* through 11*c*. This technique of generating polynomials can be extended to produce polynomials of arbitrarily high degree. For example, to add another term of x to the fourth power, the output of the UPE 45 may be multiplied by x in a fourth UPE, and to introduce a constant multiplier, x is multiplied by the constant first in a fifth UPE. For a higher order polynomial, two or more arrangements for a third order polynomial may be cascaded, as shown in FIG. 12*b*. UPEs can also be used to implement virtually any specific polynomial in a manner analogous to the cases described above with reference to FIGS. 12*a* and 12*b*.

A very simple configuration using one UPE can form a digital integrator, as suggested hereinbefore. The Y output is fed back to the A input and the B and M inputs are controlled externally. The computation performed is:

$$y_n=B\times M+y_{n-1} \quad (15)$$

At each step in the computation, the quantity $B\times M$ is summed with the result of the last step. This produces a ramp function whose slope is the product $B\times M$. As the computation proceeds, the output $y_n$ eventually overflows the number representation and wraps around to a negative number where the computation continues. The result is a repetitive ramp.

Figure 13:
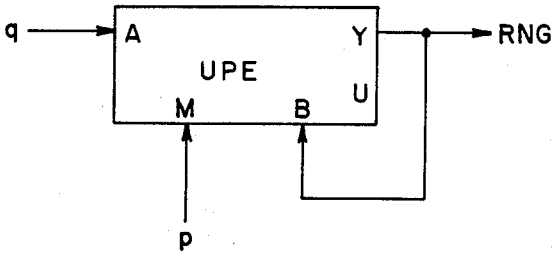
FIG. 13 PRIOR ART
FIG. 13 illustrates the implementation of a random noise generator as disclosed in the prior application Ser. No. 524,545.

Random signals find frequent application in sound synthesis. A pseudo-random number generator can be constructed with one UPE as shown in FIG. 13. This approach uses a linear congruence method implementing:

$$x_n = p \cdot x_{n-1} \bmod_r + q \tag{16}$$

where r, in the preferred embodiment, is equal to $2^{32}$. The $\bmod_r$ operation is achieved by feeding the 64-bit output Y into the 32 bit input B. Only the low 32 bits of Y get loaded, which effectively generates mod(2^32).

The linear interpolation feature of the UPEs can be used for mixing signals by feeding one signal into the B input and another into the D input. The M input controls the relative balance of the two signals in the output signal. To this there may be added another signal at the A input. This approach has the advantage over other schemes that the output level is held constant as the relative mix of the two input signals is changed.

Two musical instrument models based on UPEs will now be described. Both models, implemented in accordance with the present invention, have been used to generate musical sounds and unusual orchestrations for various plucked, struck and blown instruments individually synthesized and combined. While these models have produced extremely high quality timbres of certain string and wind instruments, they are not necessarily capable of covering the entire range of timbres in the class. The development of a new timbre may be thought of as building an instrument, learning to play it, and then practicing a particular performance on it. This activity requires a great deal of careful study, and may involve extensions or modifications to the fundamental models which will now be described.

Struck or plucked instruments are those that are played by displacing the resonant element of the instrument from its resting state, and then allowing it to oscillate freely. Tone quality in such instruments is a function of how the system is excited, and of how it dissipates energy. Examples of plucked and struck instruments include: zithers, pianos, bells, triangles, marimbas, etc.

Figure 14:
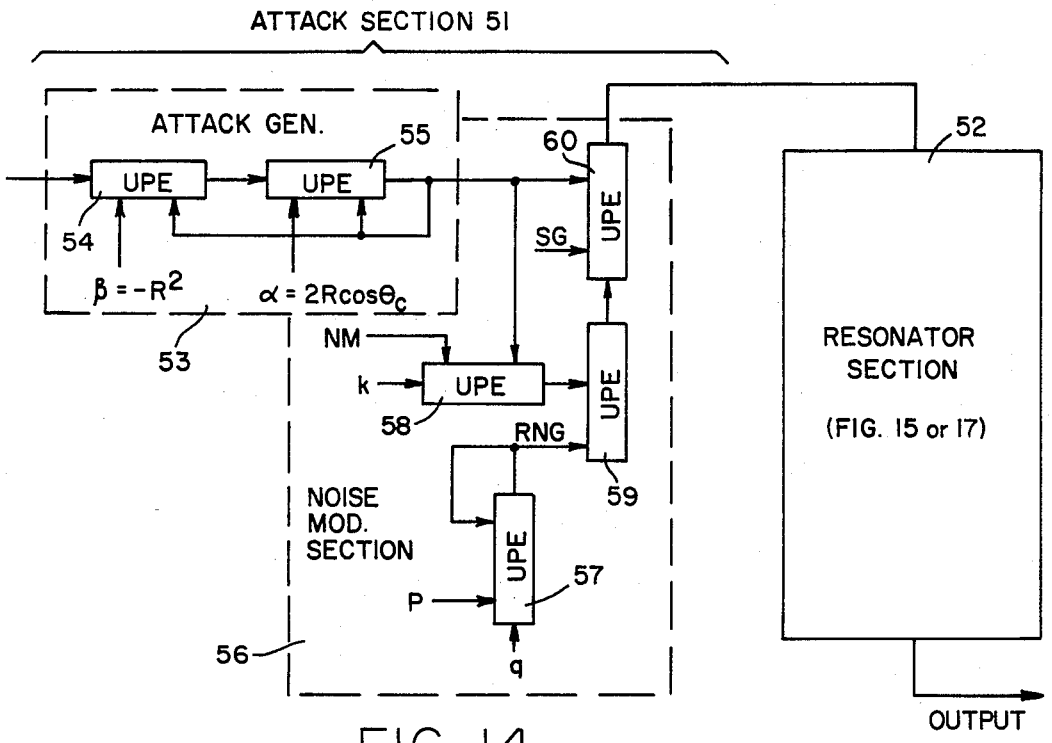
FIG. 14 illustrates an arrangement for synthesizing a struck instrument with UPEs in accordance with the present invention.

FIG. 14 illustrates a block diagram of an arrangement for synthesizing a plucked or struck instrument with UPEs. The model may be divided into two sections; the attack section 51 and the resonator section 52. The attack section models the impact of the striking or plucking device on the actual instrument. An impulse is fed to a second-order resonator section 53 that is tuned with a Q value close to critical damping.

The output of the attack resonator implemented with UPEs 54 and 55 is fed to the input of a noise modulation section 56. The noise modulation section generates the function:

$$y = RNG(NM \cdot x + k) + SG \cdot x \tag{17}$$

where RNG is the output of a random number (noise) generator implemented with one UPE 57, in a manner described with reference to FIG. 13. This computation adds to the input signal x an amount of noise proportional to the level of x. The balance of signal to noise is controlled through UPEs 58, 59 and 60 by the ratio SG:NM, and the noise gain of the noise modulation section is controlled by the coefficient NM and the signal gain by the coefficient SG. In equation (17), the product NM x plus k is computed by UPE 58 and then multiplied by RNG in UPE 59. The product SG·x is computed and added to RNG(NM·x+k) by a UPE 60.

Figure 15:
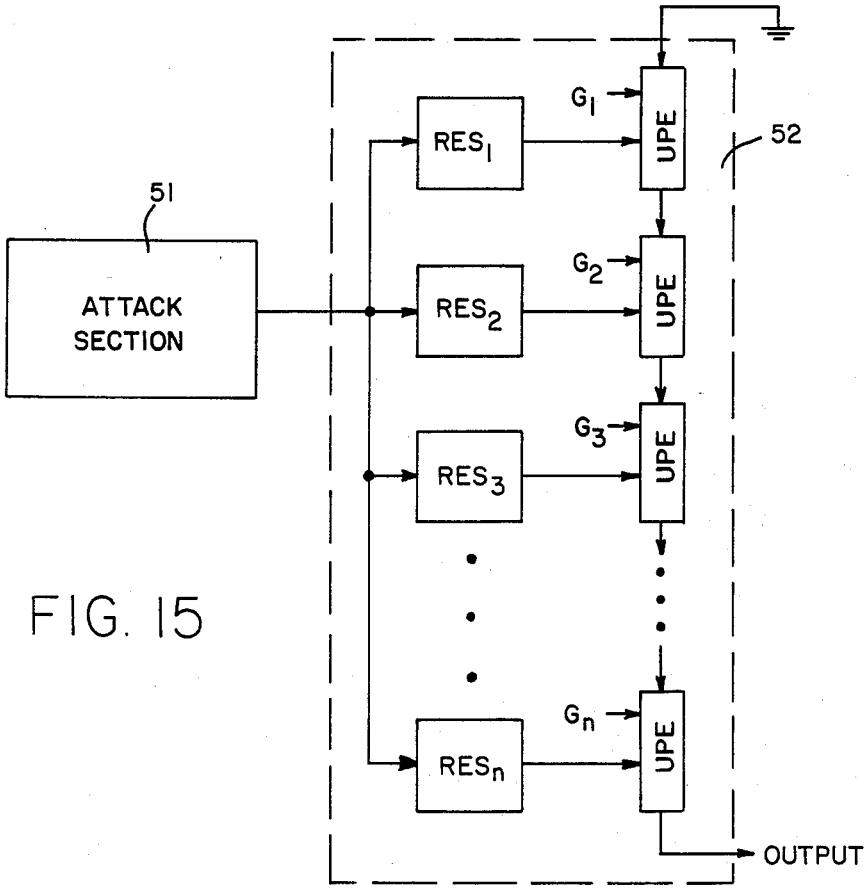
FIG. 15 illustrates the manner of connecting a bank of second order resonators to implement the resonator section of FIG. 14.

The output of the noise modulation section 56 is used to drive the resonation section 52 comprised of a bank of parallel connected second-order resonators $RES_0$, $RES_1 \ldots RES_n$ shown in FIG. 15. The resonators are tuned to the major resonances of the instrument being modeled and their outputs are multiplied by gain factors $G_1$ through $G_n$ in UPEs 1 through n which are connected in cascade to combine by addition all of the output of the resonators. The parameters of the attack section, which are attack resonator frequency and Q value, signal to noise ratio, and attack level, are all adjusted to produce a variety of musical timbers.

The gain at resonance of a resonator (a 2-pole second order section) varies drastically over the frequency range. This variation causes scaling problems when fixed point arithmetic is used. The input to or the output from each resonator must be adjusted to compensate for the implicit gain of the resonator. Several techniques exist for normalizing resonator gain. One proposed technique uses the addition of two zeros to the second-order system function. By placing a zero at $\pm\sqrt{R}$ the dependence on $\theta$ in the system function may be eliminated. Resonator gain normalization could pose a particularly severe problem in the case of a bank of resonators as shown in FIG. 15. Scaling the input to each resonator increases the amount of UPE's by a factor of one third and increases the control bandwith by the same amount. Alternatively, the input to the entire system can be scaled down, to avoid overflow in the section with the most gain, and then the output scaled up to the appropriate level. This approach is a problem in systems that use fixed point arithmetic because the amount of gain available at each multiplication is limited, and hence many multiplier stages at the output must be used. Also, the input to the first UPE need not be zero; it may instead be the output of some other section that is to be added to the output of the attack section.

Figure 16:
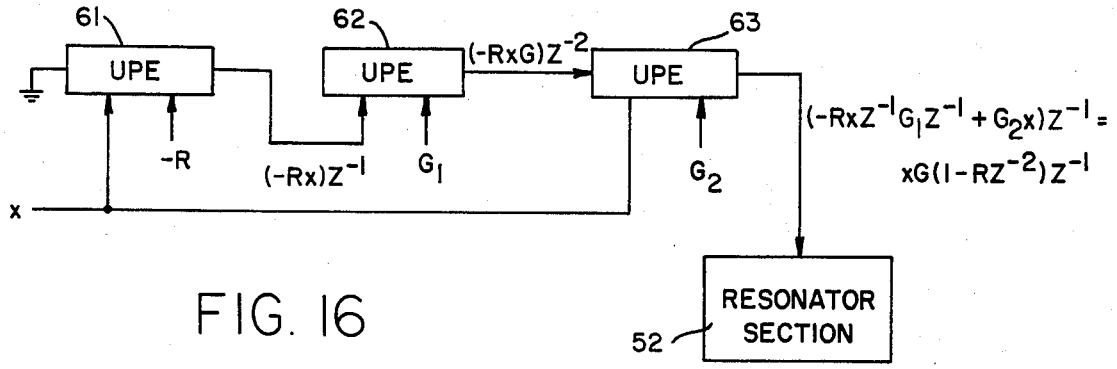
FIG. 16 illustrates an arrangement of three UPEs at the input of a resonator section for introducing two zeros in each of the two-pole resonators.

In many sound generation applications the R values of each stage in the resonator section are close in value. Therefore, in accordance with one aspect of the present invention, it is possible to synthesize a nonrecursive two-zero filter using an average value for R and then distributing the result to each resonator as shown in FIG. 16 wherein three UPEs 61, 62, 63 are used to implement the function $G(1-RZ^{-2})XZ^{-1}$, where $\pm\sqrt{R}$ define the two zeros for the average R of the two poles of the second order resonators in the resonator bank. In that manner, the input signal x to the resonator section is multiplied by the function $G(1-RZ^{-2})$ and distributed to the resonator to introduce two zeros in each of the resonators as shown in FIG. 15. The technique would, of course, apply to the resonator section of FIG. 17 as well.

In a typical application, a piano-like keyboard is used to control the instrument. The pressing of a key triggers the following actions: (1) the key position determines the coefficients loaded into the resonator section, (2) the key velocity controls the level of the coefficient NM in the attack section (higher key velocities correspond to more noise being introduced into the system and hence a higher attack level), and (3) the key press generates an impulse that is sent to the attack section 51.

Figure 17:
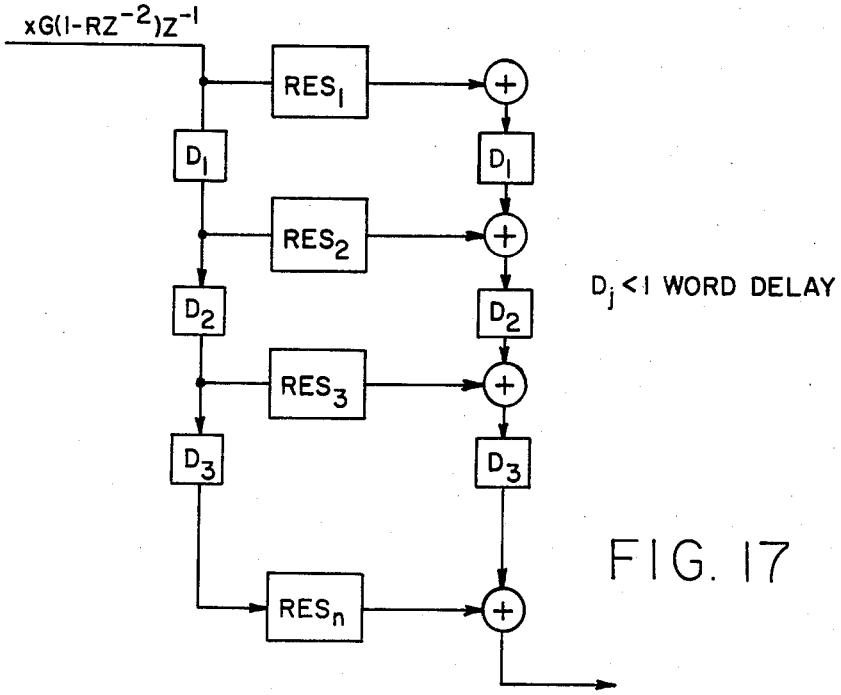
FIG. 17 illustrates an alternative arrangement for a resonator section.
Figure 18:
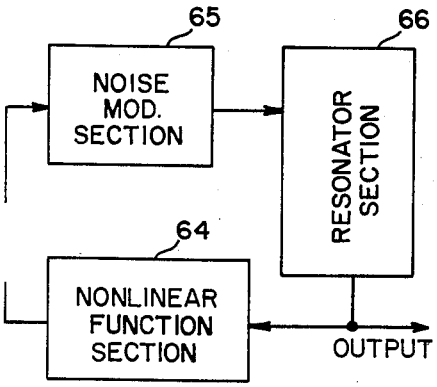
FIG. 18 illustrates an arrangement for synthesizing a blown instrument.
Figure 19:
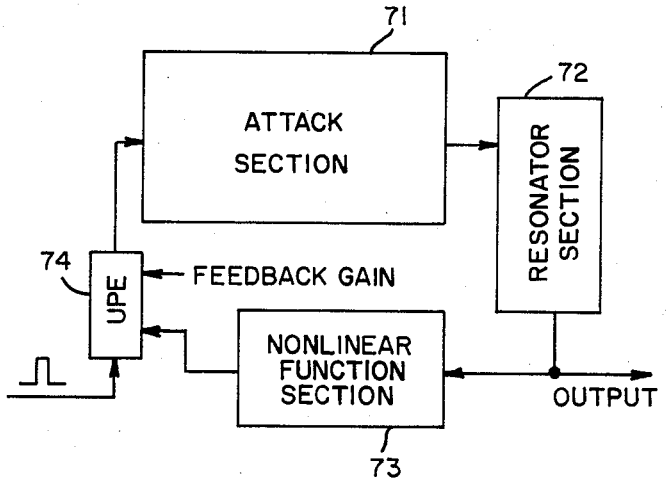
FIG. 19 illustrates an arrangement for synthesizing a voice of an instrument having characteristics of both a struck or plucked instrument and a blown instrument.

It should be noted that, since each UPE has a word delay for the data being pipelined through it, there is an accumulation of N words of delay through the UPEs of the resonator bank shown in FIG. 15, which may be a problem, especially in closed loop models such as in FIGS. 18 and 19, although in practice it has not been noticed in synthesizing the struck or plucked instrument voices, even when various voices have been combined in a melody played with a synthesized flute-like instrument accompanied by percussion instruments. However, a way to avoid the problem is to cascade the input through a chain of N−1 unit delays $D_1$ through $D_{n-1}$, where each delay is a number of bit times less than a word, and the outputs of the resonators are combined using a chain of single-bit adders and unit delays $D_1$ through $D_{n-1}$, as shown in FIG. 17, where the bit-serial adders are represented by a circle, and each unit delay is a number of bit times less than a word. The bit times for the delay units are selected such that the total delay between the resonator input to the resonator output through any one of the resonators $RES_1$ through $RES_n$ is the same and equal to an integral number of word times, such as three word times, or more if the number n of resonators is greater than the number of bits in a word. In a preferred embodiment, the total delay is exactly one word time plus the delay of one of the resonators. In the actual implementation, unit delays may be optionally included at the output of the last bit adder, and at the input of the first bit adder and the input of the junction between the first delay unit and resonator.

FIG. 18 shows a dynamic model for a blown musical instrument, implemented using UPEs. This model has been motivated by the observation that a blown musical instrument may be viewed as a nonlinear forcing function at the mouthpiece exciting the modes of a linear tube. It is composed of three sections described earlier: a nonlinear function section 64 shown in FIG. 12*a* that computes a third order polynomial; a noise modulation section 65 that adds an amount of noise proportional to the size of the signal at its input, as for the struck instrument shown in FIG. 14, and a resonator section 66 that has second-order resonators tuned to frequencies corresponding to the partials of the musical instrument, as shown in FIG. 15 for the struck instrument. These three sections are connected in a cascade arrangement forming a closed loop.

In the case where the close loop gain is sufficiently high, and the system is disturbed, it oscillates with modes governed by the tuning of the resonator bank. Typically, the loop gain is controlled by the gain of the nonlinear coefficients $G_1-G_n$. For small coefficient values, the feedback is too small and the system does not oscillate. If large enough, the system will oscillate with a very pure tone as it operates in the nearly linear range of the nonlinear section 64. If the coefficients are set to an even higher value, the signal at the output of the resonator section is increased in amplitude and the section 64 is forced into the nonlinear region. The nonlinearity shifts some energy into higher frequencies, generating a harsher, louder tone.

In a typical application the loop gain is set by controlling the coefficients $G_1-G_n$ of the resonator section according to the velocity of a key-press on a piano-like keyboard. A slowly pressed key corresponds to a small coefficient value, and thus a soft pure tone, while a quickly pressed key corresponds to a larger coefficient value, and a louder harsher tone. When the key is released, the coefficients are returned to some small value that is just under the point where the loop gain is large enough to sustain oscillation. By not returning the coefficients to zero, the signal dies out slowly with time. Thus, the time constant for the decay may be controlled by the value of the coefficients used.

A small amount of noise is injected constantly into the loop, using the noise modulation section 65 so that the system will oscillate without having to send an impulse to excite it. This model has been used successfully for generating flute-like tones.

Referring now to FIG. 19, a voice of an instrument having characteristics of either a struck or plucked instrument, a blown instrument, or both, may be synthesized with an attack section 71 organized as in the arrangement for a struck instrument shown in FIG. 14, and connected to a resonator section 72. The loop is closed through a nonlinear function (third order polynomial) section 73, much as in the blown instrument arrangement of FIG. 18, but with the loop actually closed through a UPE 74 which receives an input pulse to initiate the voice and multiplies the feedback signal with a gain coefficient. The attack and other characteristics of the voice may be adjusted by the coefficients selected for the resonator and noise modulator section. The resonance of the voice is adjusted by the coefficients of the resonator section. The purity of the tone is selected by the gain of the nonlinear function section. It will be recognized that this is essentially the arrangement just described for a blown instrument with a resonator in the loop ahead of the noise modulation section. The closed loop for the blown instrument produces a voice that comes up slowly, characteristic of a blown instrument. Introducing the resonator section 72 superimposes on an attack in the voice characteristic of a struck, or plucked, instrument. The dominant characteristic, struck or blown instrument, and the degree of dominance, is controlled by the feedback gain coefficient.

Although particular embodiments of the invention have been described and illustrated herein, it is recognized that modifications and variations may readily occur to those skilled in the art. Consequently, it is intended that the claims be interpreted to cover such modifications and variations.

What is claimed is:

1. In a digital system for synthesizing voices of musical instruments, an attack section comprising a second order resonator responsive to an input pulse to provide an output signal that rises rapidly and decays slowly, and means for modulating random noise on the output signal of said second order resonator with an amplitude of noise that is a function of said output signal wherein said random noise modulating means is comprised of a random number generating means and means for computing the function $y=x(NM \cdot RNG+SG)$ where x is the output of said second order resonator, NM is a noise modulation coefficient, RNG is the output of said random number generating means, and SG is a signal gain coefficient.

2. In a digital system for synthesizing voices of musical instruments, an attack section comprising a second order resonator having an input signal $x_n$ and an output signal $y_n$ responsive to an input pulse to provide an output signal that rises rapidly and decays slowly, and means for modulating random noise on the output signal of said second order resonator with an amplitude of noise that is a function of said output signal, said resonator being comprised of a plurality of two-pole linear filters connected in parallel to form a resonator, the output of which is the output of said digital system for synthesizing voices of a musical instrument wherein each filter comprises first pipeline means for computing $(-R^2Y+X)Z^{-1}$, where X is the current value of said input signal $x_n$ and Y the current value of said output signal $y_n$, and a second pipeline means for computing and adding to the output of said first computing means the function $(2R\cos\theta Y)Z^{-1}$, thereby producing as the output of said second computing means the function $[2R\cos\theta_c Y+(-R^2Y+X)Z^{-1}]Z^{-1}$, where $Z^{-1}$ is a word delay of each of said pipeline computing means, R is the radial distance of two filter poles from the origin in the Z-plane, and $\theta_c$ is the angle of the poles off the real axis defining the center frequency of the filter response in a Z transform of a conventional second-order linear differential equation $y_n=\alpha y_{n-1}+\beta y_{n-2}+x_n$, where $\alpha$ and $\beta$ are constant coefficients.

3. A digital system for synthesizing voices of musical instruments, comprised of a closed loop having a nonlinear function computing means for computing a third order polynomial from its input signal $x_n$, and a resonator section responsive to the output $y_n$ of said nonlinear function computing means, wherein said resonator section is comprised of first pipeline means for computing $(-R^2Y+X)Z^{-1}$, where X is the current value of said input signal $x_n$ and Y the current value of said output signal $y_n$, and a second pipeline means for computing and adding to the output of said first computing means the function $(2R\cos\theta Y)Z^{-1}$, thereby producing as the output of said second computing means the function $[2R\cos\theta Y+(-R^2Y+X)Z^{-1}]Z^{-1}$, where $Z^{-1}$ is a word delay of each of said pipeline computing means, R is the radial distance of two filter poles from the origin in the Z-plane, and $\theta_c$ is the angle of the poles off the real axis defining the center frequency of the filter response in a Z transform of a second-order linear differential equation $y_n=\alpha y_{n-1}+\beta y_{n-2}+x_n$.

* * * * *